United States Patent [19]

Leland

[11] 4,066,194

[45] Jan. 3, 1978

[54] SOCK DONNING ASSIST DEVICE

[76] Inventor: Ragnvald G. Leland, P.O. Box 4174, Palm Springs, Calif. 92262

[21] Appl. No.: 792,415

[22] Filed: Apr. 29, 1977

[51] Int. Cl.[2] ..... A47J 51/06
[52] U.S. Cl. ..... 223/111
[58] Field of Search ..... 223/111, 112, 113, 114

[56] References Cited

U.S. PATENT DOCUMENTS

| | | | |
|---|---|---|---|
| 2,796,207 | 6/1957 | Young | 223/111 |
| 2,828,057 | 3/1958 | MacLauchlan | 223/111 |
| 3,231,160 | 1/1966 | Glanville | 223/111 |
| 3,452,907 | 7/1969 | MacLauchlan | 223/111 |
| 3,715,065 | 2/1973 | Peck | 223/111 |

FOREIGN PATENT DOCUMENTS

| | | | |
|---|---|---|---|
| 717,012 | 10/1966 | Italy | 223/111 |
| 343,094 | 1/1960 | Switzerland | 223/111 |

*Primary Examiner*—George H. Krizmanich
*Attorney, Agent, or Firm*—Berman, Aisenberg & Platt

[57] ABSTRACT

A device for assisting one in the donning of a sock, stocking, or like foot covering. In a preferred form, the device comprises a handle member from which laterally and transversely depend a pair of sock expanding and gripping members. The sock expanding and gripping members are designed to be placed within the sock and serve to spread same longitudinally, horizontally and vertically to permit easy entry of the foot. The user then brings the foot covering about the foot and ankle and utilizes a unique combination frame positioner and sock release device to release the sock and withdraw the device.

15 Claims, 6 Drawing Figures

SOCK DONNING ASSIST DEVICE

BACKGROUND OF THE INVENTION

1. Field of the Invention

The present invention relates to a sock donning assist device and, more particularly, to a device which enables an individual to put on a sock, stocking, or like foot covering with great ease.

2. Description of the Prior Art

Many devices have been proposed for the express purpose of facilitating the donning of a foot covering, such as a sock or stocking, by a person whose body movement is somehow limited by reason of injury, old age, pregnancy, or the like.

I am, in fact, aware of the following U.S. Pat. Nos. whose teachings are generally directed towards such devices: 1,315,096; 2,828,057; 2,919,840; 3,070,271; 3,231,160; 3,452,907; 3,604,604; 3,692,217; 3,715,065; 3,727,812; 3,808,008; 3,853,252; and 3,860,156.

Of the foregoing, U.S. Pat. No. 3,715,065 to Peck is typical in illustrating a U-shaped tubular member having a closed end and curved side portions. A sock is placed onto holders which extend from the free end of the curved side portions in such a fashion to enable same to be drawn onto the foot of the user.

U.S. Pat. No. 1,315,096 to Deiley teaches a sock puller which utilizes a pair of handle members which, when pressure is applied, act to separate a pair of arcuate support members which fit into the open end of a sock so as to expand same when pressure is applied to the handle.

The MacLauchlan U.S. Pat. Nos. 3,452,907 and 2,828,057 teach the provision of a pair of strap members which terminate in a garter that is clamped to the edge of the sock, the strap members being used in combination with another device for guiding the sock or stocking onto the foot.

While each of the above-cited devices is directed towards the same end, I have found their structures to be deficient in several respects. One of the more serious disadvantages of the prior art devices is the failure to provide for any give or resiliency in the devices which, in turn, can make the utilization thereof a painful experience. Further, the sock gripping and pulling devices are generally far too complex, require a multitude of parts, some of which must be manufactured to close tolerances and/or are moving parts, and are generally, therefore, quite expensive.

A more serious objection to the prior art devices concerns their difficulty in use. It appears that the devices of the prior art would require a large amount of time-consuming effort and energy which may be far beyond the capacities of those individuals for whom such devices are mostly needed.

Another disadvantage to the devices of the prior art is that there exists no convenient or easily operable means for releasing the sock from the devices after the sock has been donned. With many of the devices, the user must perform physical acrobatics, the need for which such devices were originally designed to prevent, in order to simply release the sock after it has been donned. Clearly, the situation is in need of remedy.

Another disadvantage of the prior art devices is that, generally speaking, they are not adjustable to individuals having different foot sizes, sock sizes, or statures, which requires a plurality of different sized assist devices to be manufactured at concomitant increased costs and expense to the consumer.

OBJECTS AND SUMMARY OF THE INVENTION

It is therefore a primary object of the present invention to provide a device for assisting an individual in the donning of a sock, stocking, or like foot covering which overcomes all of the disadvantages noted above with respect to the prior art devices.

Another object of the present invention is to provide a novel and unique device for assisting an individual in donning a foot covering, such as a sock or stocking, which is designed to guide the foot covering easily and effectively up the leg using one or both hands.

A further object of the present invention is to provice a sock donning assist device which includes an automatic means for releasing the sock once donned.

A still further object of the present invention is to provide a sock donning assist device which is simple in construction, light in weight, simple to operate, and may be inexpensively manufactured.

An additional object of the present invention is to provide an assist device for donning a sock, stocking or like foot covering which may be used without pain and discomfort and which provides a mechanism to facilitate release of the sock after it has been donned.

Utilization of the present invention saves time, minimizes effort, and provides an easily utilized and inexpensive means for an injured, invalid, or otherwise handicapped individual for the task at hand.

The foregoing and other objects are attained in accordance with one aspect of the present invention through the provision of a device for assisting in the donning of a foot covering, which comprises handle means, insert means extending integrally from the handle means and adapted to be placed within a foot covering for spreading same, and means connected to the handle means for releasing the foot covering after the sock has been donned.

The insert means is preferably adapted to spread the foot covering longitudinally, vertically and horizontally to provide an easy, deep opening into which the foot of the user may be easily placed. The handle means includes spring means integrally formed therein for urging the insert means to be normally spread apart, the insert means preferably comprising a pair of substantially identical, laterally spaced foot covering inserts which are normally urged apart laterally from one another by the spring means. More specifically, each of the inserts comprises an upper frame member, a vertically spaced lower frame member, and a connecting member joining the upper and lower frame members. The upper frame members may each include a corrugated portion for maintaining the foot covering on the device until it is desired to be released.

In accordance with more specific aspects of the present invention, the handle means includes a pair of laterally spaced, elongated frame members connected near one end thereof to one another by connecting means, and connected at the other end thereof to the upper frame member of the insert means.

In accordance with yet other aspects of the present invention, the foot covering releasing means also comprises means for releasably maintaining the insert means and the spaced, elongated frame members in a fixed, spaced relationship. The means releasably connected between the frame members comprises a transversely extending crossbar that is pivotally mounted to one of the pair of frame members at one end thereof and which has a latch member at the other end thereof for releasably retaining same to the other of the frame members. The foot covering releasing means comprises a catch member which is rigidly connected to the crossbar by a vertical connecting rod so as to be pivotable therewith. The catch member is preferably pivotally positioned adjacent the lower portion of one of the frame members and is pivotable between a first, foot covering retaining position oriented transversely to the insert means, and a second, foot covering release position where it is oriented parallel to the insert members.

BRIEF DESCRIPTION OF THE DRAWINGS

The foregoing and other objects, aspects, uses and advantages of the present invention will be more fully appreciated as the same become better understood from the following detailed description of the present invention when considered in connection with the accompanying drawings, in which.

DETAILED DESCRIPTION OF THE PREFERRED EMBODIMENT

Figure 1:
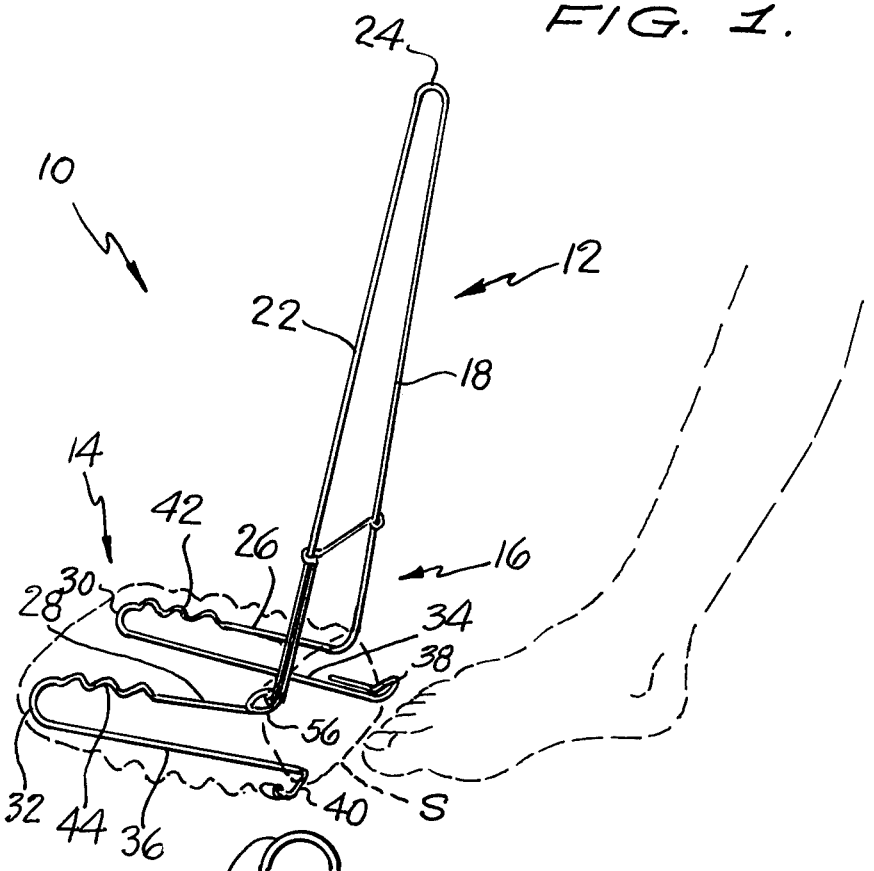
FIG. 1 is a perspective view which illustrates a preferred embodiment of the present invention and diagramatically illustrates its utilization in combination with a foot covering and the foot of a user.

Referring now to the drawings, wherein like reference numerals indicate identical or corresponding parts throughout the several views, reference numeral 10 in FIG. 1 indicates generally a preferred embodiment of the present invention which is intended to assist an individual in the donning of a foot covering such as a sock, stocking, or the like.

The assist device 10 is preferably made from a long, durable and inexpensive, spring wire loop which is bent in the desired fashion so as to form a handle portion 12, a sock expanding and gripping portion 14, and a combination sock release portion and frame stiffener 16.

The handle portion 12 is generally vertically oriented, while the sock expanding and gripping portion 14 extends from the lower end a handle portion 12 and substantially transversely and forwardly thereof. The combination sock release portion and frame stiffener 16 is not integrally formed with the handle portion 12 and sock expanding and gripping portion 14, but is attached thereto and cooperates therewith in a manner to be described in greater detail hereinafter.

The handle portion 12 comprises a U-shaped grip or handle member consisting of a pair of elongated side frame members 18 and 22 which are joined at the top portion thereof by a spring-imparting end member 24. End member 24 has a predetermined spring force which normally biases side frames 18 and 22 away from one another.

Figure 2:
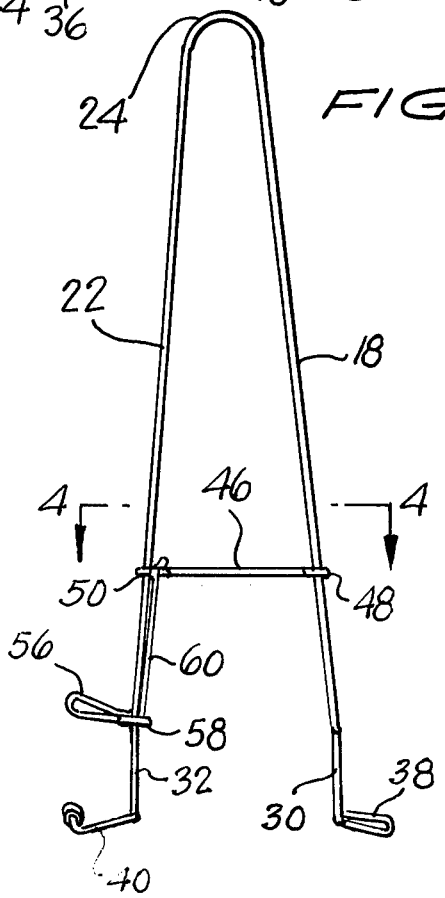
FIG. 2 is a rear view of the preferred embodiment of the present invention illustrated in FIG. 1.
Figure 3:
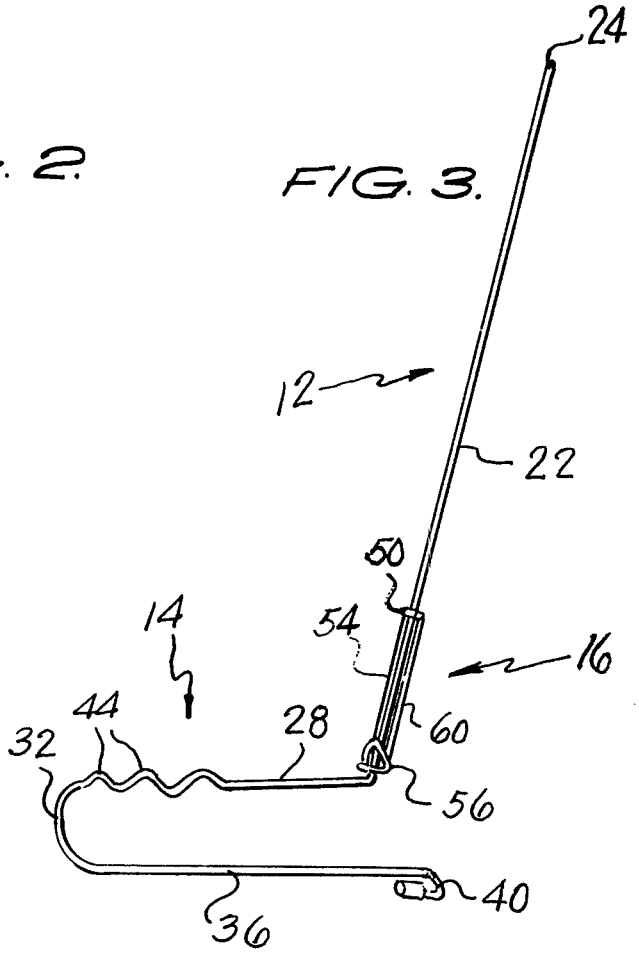
FIG. 3 is a side view of the preferred embodiment illustrated in FIG. 2.

The sock expanding and gripping portion 14 comprises a pair of forwardly projecting members or bars 26 and 28 which extend integrally from the lower end of side frames 18 and 22, respectively. Forwardly projecting bars 26 and 28 are substantially parallel with one another and terminate in a downwardly projecting end portion 30 and 32, respectively, from which, in turn, extend a pair of substantially parallel, lower, rearwardly projecting members or bars 34 and 36, respectively. The members 34 and 36, in turn, terminate in a pair of sock stop members 38 and 40 which are flared outwardly and laterally with respect to bars 34 and 36, as seen clearly in FIG. 2.

The forwardly projecting members 26 and 28 may include corrugated or wavy portions 42 and 44, for a purpose to be described in more detail hereinafter.

The design of the substantially identical pair of insert members which comprise the sock expanding portion 14 is such that the sock S placed thereabout will be automatically expanded longitudinally, horizontally, and vertically. The longitudinal expansion results from the length of the respective forward and rearward projecting bars 26, 28 and 34, 36. The horizontal expansion results from the separation of the left and right members by virtue of either the spring action of member 24, or by virtue of the forced separation by means of a crossbar 46 to be explained in more detail below. The vertical separation results from the vertical spacing of the upper members 26, 28 from the lower members 34, 36.

Figure 4:
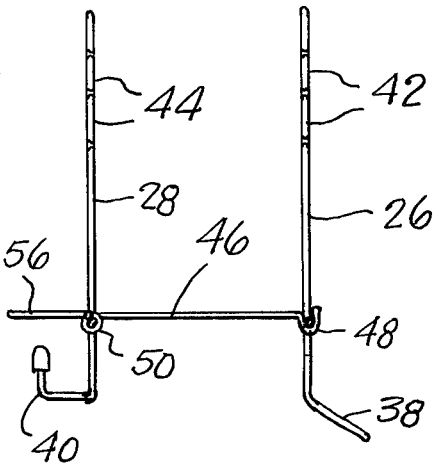
FIG. 4 is a cross-sectional view of the preferred embodiment illustrated in FIG. 2 and taken along line 4—4 thereof.
Figure 6:
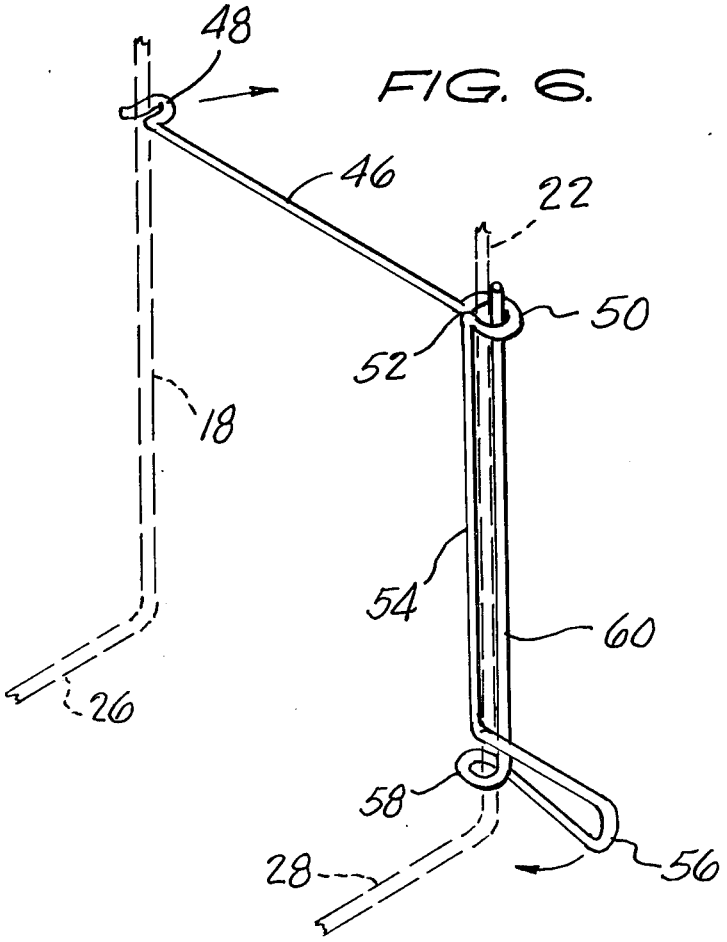
FIG. 6 is a front, enlarged, perspective view which illustrates the sock release and frame member positioning means of the present invention in greater detail, and illustrates same in its first, sock retaining position.

The combination sock release portion and frame stiffener, seen most clearly in FIG. 6, includes a rigid crossbar member 46 which terminates in one end in an open hook 48 which is designed to be releasably placeable about the frame member 18 in the manner illustrated in FIG. 4. The other end of crossbar 46 terminates in a loop 50 which may be snap fit via the forceable junction 52 about the other frame member 22.

The distal end of loop 50 extends downwardly so as to form a substantially vertical connecting rod 54. The bottom of rod 54 flares out laterally so as to form an outwardly extending sock-release loop 56 which, as illustrated in FIG. 6, is in its first, sock retaining position. Sock-release loop 56 curls back inwardly towards the frame member 22 and has integrally formed therefrom a second guide member or loop 58 which is placed about frame member 22 and then is bent back upwardly so as to form a second vertical rod 60 which lends stability to the pivot mechanism by extending through the upper loop 50, as illustrated clearly in FIG. 6.

Figure 5:
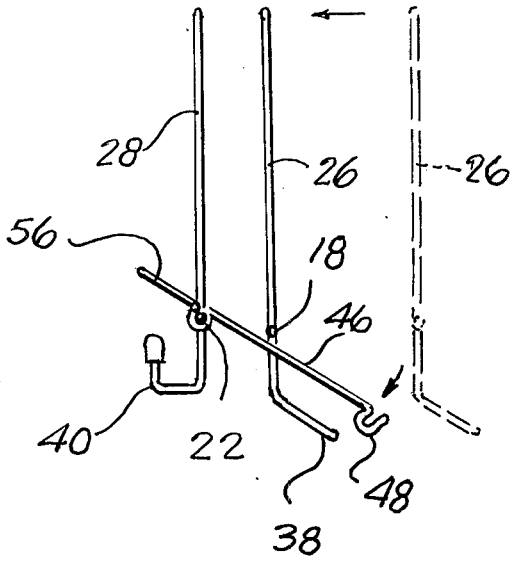
FIG. 5 is a view similar to that shown in FIG. 4, but illustrating the relative position of the components after the sock release member has been actuated.

The combination sock release portion and frame stiffener 16 is pivotable between a first position illustrated in FIG. 4 where the crossbar 46 maintains the frame members 18 and 22 in a fixed, spaced relationship as indicated, to the position illustrated in FIG. 5 where, upon pivoting the crossbar 46 about pivot loop 50 and frame member 22, the frame members 18 and 26 are released from their expanded position to contract towards one another. Simultaneously, the outwardly extending sock release loop 56 moves clockwise about pivot point 22, for a purpose to be described below.

In the preferred mode of utilization of the present invention, initially the sock is pulled and pleated to the toe on one hand of the user, and the device 10 is held in the other hand in such a fashion that the portion 16 is in its released or open position so as to permit the user to grasp frame members 18 and 22 and draw same together to permit easy insertion of the sock expanding portion 14 into the mouth of the sock S. Once the sock has been pulled to the rear of the portion 14, as defined by sock stops 38 and 40, the frame stiffener 16 is pivoted about frame 22 until open hook 48 engages frame member 18 to maintain same in the position illustrated in FIG. 1. At the same time, the rear edge of the sock S has been placed over the outwardly extending sock-release loop 56 such that the sock is firmly gripped by same.

When the sock is in position as illustrated in FIG. 1, the handle 12 is pulled rearwardly over the foot of the user. Insertion of the foot is facilitated by the wide opening provided in the sock by the insert means 14. When the toes of the user hit the rearmost portion of the sock, the user pivots the handle 12 forwardly and may rotate the handle 12 to facilitate the pulling of the end of the sock over the heel and ankle. The corrugations 42 and 44 will slowly release the sock as it is drawn up the leg of the user. When the sock is fully placed on the leg, the user simply releases the cross bar 46 by pivoting same clockwise as illustrated in FIG. 5. This, in turn, has the effect of releasing the insert members 14 from the sock proper, since they collapse towards one another under the action of spring 24. Further, the sock-retaining member 56 is pivoted forwardly so as to release the end of the sock from its grip. The entire device 10 may then be easily and simply removed after the sock is in place.

It may be appreciated that by virtue of the foregoing I have provided an inexpensive, easy to operate, lightweight, and painless way for an injured or otherwise handicapped individual to put on his socks, stockings, or other foot coverings without having to bend over or perform undue contortions. The device is essentially adjustable to accommodate all size stockings, socks, and feet. The unique sock release device acts to retain the sock onto the device until it is fully installed, and permits quick, easy and simple release and removal of the entire device at the desired moment. The springwire loop construction is inexpensive, durable, and readily available.

The construction of the release portion 16 enables easy installation of same onto the handle portion 12 and insert portion 14. The loop 58 of portion 16 need simply be fed over the open end 40 along the wires 36, 32 and 28 to the desired position, and the loop 50 may then be press-fit into place via junction 52 about frame member 22. The loop member 56 is curved in design so as to prevent snags, hangups, or the like.

Obviously, numerous modifications and variations of the present invention are possible in light of the above teachings. It is therefore to be understood that within the scope of the appended claims, the invention may be practised otherwise than as specifically described herein.

I claim as my invention:

1. A device for assisting in the donning of a foot covering, which comprises:

handle means including a pair of laterally spaced, elongated frame members;

insert means extending integrally from said handle means and adapted to be placed within a foot covering for spreading same; and means connected to said handle means for releasing said foot covering which comprises means releasably connected between said pair of laterally spaced, elongated frame members for releasably maintaining same in a fixed, spaced position.

2. The device as set forth in claim 1, wherein said insert means is adapted to spread said foot covering longitudinally, vertically and horizontally.

3. The device as set forth in claim 1, wherein said handle means includes spring means integrally formed therein for urging said insert means to be normally spread.

4. The device as set forth in claim 1, wherein said insert means comprises a pair of substantially identical, laterally spaced foot covering inserts which are normally urged apart laterally from one another by spring means.

5. The device as set forth in claim 4, wherein each of said inserts comprises an upper frame member and a vertically spaced lower frame member.

6. The device as set forth in claim 5, wherein each of said inserts further comprises a connecting member joining said upper frame member to said lower frame member.

7. The device as set forth in claim 6, wherein each of said upper frame members includes a corrugated portion.

8. The device as set forth in claim 1, wherein said pair of laterally spaced, elongated frame members are connected near one end thereof to one another by connecting means and connected at the other end thereof to said insert means.

9. The device as set forth in claim 8, wherein said insert means comprises a pair of substantially identical, laterally spaced inserts each having an upper insert member extending transversely from one of said pair of elongated frame members, and a lower insert member extending integrally from and laterally spaced below said upper insert member.

10. A device for assisting in the donning of a foot covering, which comprises:

handle means;

insert means extending integrally from said handle means and adapted to be placed within a foot covering for spreading same; and means connected to said handle means for releasing said foot covering also comprising means for releasably maintaining said insert means in a spread condition.

11. The device as set forth in claim 8, wherein said means releasably connected between said frame members comprises a transversely extending crossbar pivotally mounted to one of said pair of frame members at one end thereof and having a latch member at the other end thereof for releasably retaining same to the other of said frame members.

12. The device as set forth in claim 11, wherein said foot covering releasing means comprises a catch member rigidly connected to said crossbar so as to be pivotable therewith.

13. The device as set forth in claim 12, wherein said catch member is pivotable between a first, foot covering retaining position and a second, foot covering release position.

14. The device as set forth in claim 13, wherein said catch member is pivotally positioned adjacent the lower portion of one of said frame members and is connected to said crossbar by a vertical connecting rod.

15. The device as set forth in claim 14, wherein said catch member is positioned transversely of said insert means in said first position and is parallel to said insert members in said second position.

* * * * *